United States Patent [19]

English et al.

[11] 4,169,237

[45] Sep. 25, 1979

[54] HIGH VOLTAGE MOVIE LIGHT AND INCANDESCENT LAMP UNIT FOR USE THEREWITH

[75] Inventors: George J. English, Reading; Robert E. Levin, South Hamilton, both of Mass.; Raymond T. Fleming, Lexington, Ky.

[73] Assignee: GTE Sylvania Incorporated, Stamford, Conn.

[21] Appl. No.: 939,930

[22] Filed: Sep. 6, 1978

[51] Int. Cl.[2] ..... H01K 1/14; H01K 1/32

[52] U.S. Cl. ..... 313/1; 313/115; 313/116

[58] Field of Search ..... 313/111, 116, 113, 114, 313/115, 1; 362/346, 304, 297

[56] References Cited

U.S. PATENT DOCUMENTS

| | | | |
|---|---|---|---|
| 2,387,038 | 10/1945 | Owens | 362/346 X |
| 2,411,568 | 11/1946 | Foote | 313/1 X |
| 2,810,660 | 10/1957 | Carpenter | 313/113 X |
| 4,021,659 | 5/1977 | Wiley | 362/297 |

*Primary Examiner*—Palmer C. Demeo
*Attorney, Agent, or Firm*—Lawrence R. Fraley

[57] ABSTRACT

A high voltage movie light including a plastic holder, a pair of spaced-apart incandescent lamp units positioned within the holder, and means for electrically connecting the lamp units to an external power source. Each lamp unit comprises a formed glass reflector and a tungsten-halogen lamp located within the reflector and having a planar, dual filament structure therein. The lamp units are positioned within the holder such that the planes occupied by the respective dual filament structures intersect at a predetermined angle, e.g. 90 to 110 degrees, in order that the light output from each unit will be centered on a respective diagonal of the rectangular subject field being illuminated by the movie light. Each unit produces a bimodal intensity distribution, thus further assuring increased illumination levels on the subject field. An incandescent lamp unit suitable for use in the movie light is also disclosed.

20 Claims, 7 Drawing Figures

HIGH VOLTAGE MOVIE LIGHT AND INCANDESCENT LAMP UNIT FOR USE THEREWITH

CROSS REFERENCE TO RELATED APPLICATIONS

An application listed under Ser. No. 939,928, entitled "Movie Light, Low Voltage Incandescent Lamp Unit For Use Therewith, And Reflector" and assigned to the same assignee as the instant invention, was filed concurrently herewith. In Ser. No. 939,928, there is described a movie light which utilizes a pair of low voltage lamp units, each including a planar, single filament structure. Also described in Ser. No. 939,928 is a lamp unit suitable for use with the movie light and a reflector member especially suited for use with said unit.

BACKGROUND OF THE INVENTION

The invention relates to incandescent lamps and particularly to equipment which utilize such lamps to provide light for the production of motion pictures. Such equipment will hereinafter be referred to as "movie lights."

A recent development in the motion picture field is the "instant movie" system designed by the Polaroid Corporation, Cambridge, Mass. This system includes an automatic-exposure movie camera in which a film-containing cassette is used. Exposure of the film occurs within the cassette which is inserted within a special projector, or "player" and the film projected on the player's screen. Processing of the film requires only about ninety seconds.

The present invention is especially adapted for utilization with the above movie system, in addition to other systems requiring similar levels of illumination. As will be described, the present invention is electrically operated and fully capable of being mounted on a movie camera such as the above. Understandably, the function of the invention is to substantially uniformly illuminate a subject field located at a prescribed distance from the camera during periods of use in which normally satisfactory illumination is not otherwise available. By uniformly illuminated is meant a corner-to-center illumination ratio within the range of about 0.32 to about 0.45 for a rectangular subject field located at a distance of approximately fifteen feet from the movie camera. That is, the center of the subject field at this distance requires a level of illumination of about three times the level needed for the corners of the field. A typical field is about fifty-eight inches (vertical) by seventy-eight inches (horizontal). A desired luminous intensity at the center of the field is within the range of about 14,000 to 17,000 candelas while that of the respective corners of the field is within the range of about 5,000 to 7,000 candelas.

Most known systems capable of providing the above illumination are relatively expensive to both operate and purchase as well as very awkward to operate when used in conjunction with movie cameras.

In the system of Ser. No. 939,928, the movie light contains two low voltage incandescent lamp units, each having a single, planar filament therein. Each unit has an operating voltage of 50 to 65 volts. In the high voltage movie light system defined by the present invention, each of the lamp units has an operating voltage within the range of from about 100 to about 130 volts. Accordingly, the movie light has a total operating voltage of about 200 to 260 volts when the lamp units are joined in series. This makes the movie light ideally suited for high-voltage environments such as Europe. The increased operating voltage is possible as a result of providing each lamp with a dual filament structure secured within the lamp in a more positive manner than the single filaments employed in the lamps of Ser. No. 939,928. The intensity distribution produced on a subject field by each unit in the movie light is bimodal which assures a relatively uniform illumination of the field. It is also possible in the present invention to employ a single unit as the movie light, thus making the system suited for use in normal line voltage, e.g. 100 to 120 volts, environments such as this country.

It is believed, therefore, that a high voltage movie lighting system which is capable of providing the above-desired levels of illumination would constitute an advancement in the art. It is further believed that a lamp unit capable of being used as part of such a system or singularly as a movie light would also constitute an advancement in the art.

OBJECTS AND SUMMARY OF THE INVENTION

It is, therefore, a primary object of the present invention to provide a high voltage movie light capable of providing the levels of uniform illumination defined above.

It is a further object of the invention to provide such a movie light which is capable of being readily mounted on a movie camera.

It is still another object of the invention to provide a lamp unit for use with the aforedescribed movie light.

In accordance with one aspect of the invention, there is provided a high voltage movie light which comprises a holder, a pair of spaced-apart lamp units within the holder, and means for electrically connecting both units to an exteral power source. Each unit includes a reflector with an incandescent lamp positioned substantially therein. Each lamp, in turn, includes a planar dual filament structure such that when the units are oriented in the light in the manner defined, the bimodal intensity distribution produced from each unit will occupy a respective one of the diagonals of the rectangular subject field being illuminated.

In accordance with another aspect of the invention, there is provided a lamp unit which includes an incandescent lamp positioned within a reflector which has an internal diffusing surface divided into three different diffusing regions. The lamp includes a light-transmitting envelope with a planar dual filament located therein.

DETAILED DESCRIPTION OF THE PREFERRED EMBODIMENTS

For a better understanding of the present invention together with other and further objects, advantages, and capabilities thereof, reference is made to the following disclosure and appended claims in connection with the above-described drawings.

Figure 1:
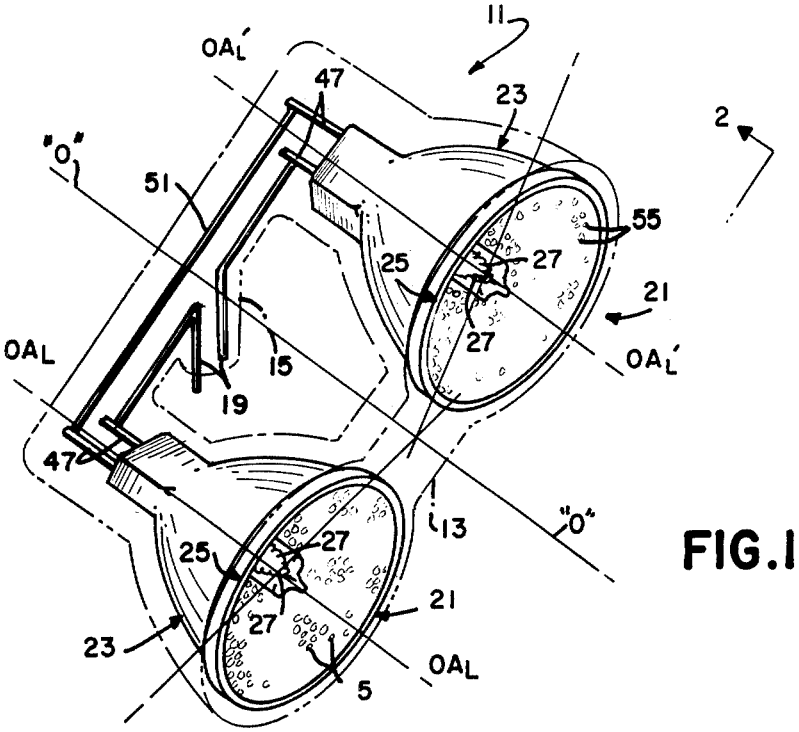
FIG. 1 is an isometric view of a high-voltage movie light in accordance with a preferred embodiment of the invention.
Figure 2:
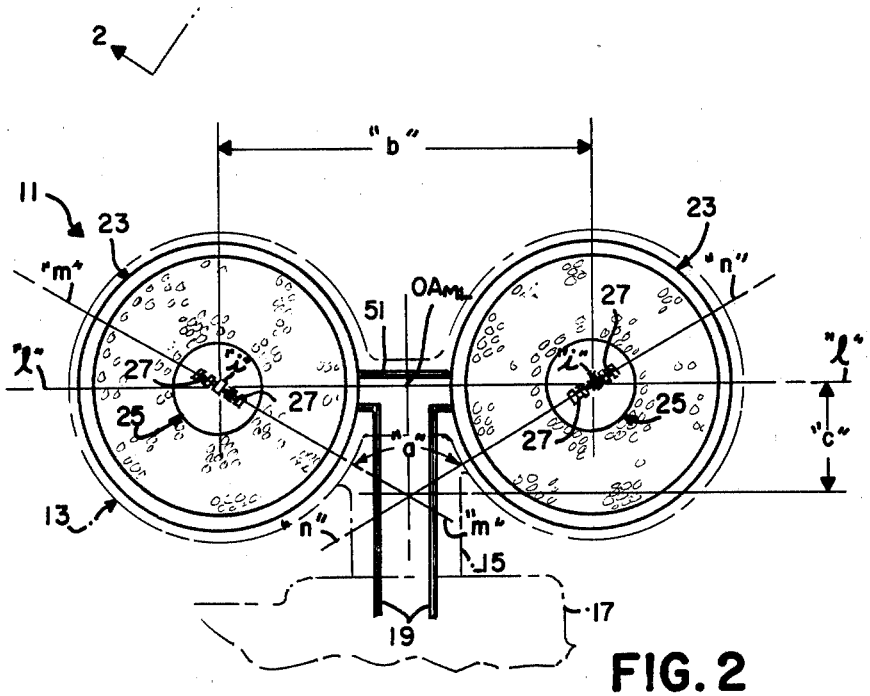
FIG. 2 is a front elevational view of the embodiment of FIG. 1 as taken along the line 2—2 in FIG. 1.

With particular reference to FIGS. 1 and 2, there is shown a high voltage movie light 11 in accordance with a preferred embodiment of the invention. By high voltage is meant an operating voltage within the range of from about 200 to about 260 volts when the lamp units 21 of the invention are electrically joined in series. In the event that these units are joined in parallel, high voltage defines an operating range from about 100 to 130 volts. Light 11 includes a holder 13 (shown in phantom for the purpose of clarity) which includes a base portion 15 adapted for being mounted on a movie camera 17 (shown in phantom in FIG. 2) such as the previously described "instant movie" camera developed by the Polaroid Corporation. It is of course understood that light 11 is capable of being successfuly used with other types of cameras, including conventional 8 mm., super-8, and 16 mm. systems, provided a suitable adapter is used. Housing 13 is of insulative material e.g. plastic. Base portion 15 includes a pair of projecting terminals 19 which connect the lamp units of light 11 in a manner to be described. Terminals 19 are adapted for being plugged into a corresponding socket located within camera 17 and electrically joined to the circuitry associated therewith. Accordingly, light 11 will be electrically connected to the same power source as the camera. If it is desired not to mount light 11 atop camera 17 as shown in FIG. 2, it is well within the scope of the invention to simply connect terminals 19 to the above power source via other means, e.g., a suitable extension cord with a socket adapted to receive base 15. Spacedly positioned within holder 13 is a pair of lamp units 21. Units 21 are similar, each including a formed glass reflector 23 with an incandescent lamp 25 located therein. Each lamp 25 has an operating voltage within the range of from about 100 to about 130 volts, a rated wattage of about 105 watts, an average operational life of about 8 hours, and a lumen rating of approximately 2700 lumens.

Reflectors 23 are preferably formed of borosilicate glass and are secured within holder 13 such that the respective optical axes ($OA_L$—$OA_L$ and $OA_L'$—$OA_L'$-)are parallel. These axes are also preferably located in the same plane "1"—"1" as the optical axis $OA_{ML}$ (FIG. 2) of light 11 and are parallel to said axis.

Lamps 25 are preferably of the tungsten-halogen variety. In tungsten-halogen lamps, the tungsten which comprises the filament material evaporates from the filaments during operation and combines with the halogen in the lamp to form a gaseous halide. This resulting combination prevents the tungsten from depositing on the internal wall of the lamp's glass envelope 26 (in FIG. 3). Upon returning to the filaments, the halide decomposes, resulting in the deposition of tungsten back onto the filaments and the release of additional halogen gas to assure continuation of the cycle. The halogen cycle is well known in the incandescent lamp art and lamps employing it have been on the market for some time.

In the present invention, each lamp 25 contains a planar, dual filament structure which includes a pair of filament elements 27 joined in series. Accordingly, by dual filament is meant a structure capable of providing two luminous sources to the respective reflector 23. Each element is preferably a straight, helical coiled tungsten member, both of said members intersecting at a point ("i") which lies on the optical axis of the respective reflector. Filaments 27 are thus oriented within lamp 25 at a pre-established angle ("d") which is preferably within the range of about 15 to 100 degrees. In one embodiment of the invention, angle "d" was about 70 degrees. As stated, each filament structure is planar with the pair of filaments 27 of one lamp occupying a first plane "m"—"m" and the pair of filaments of the other lamp occupying a second plane "n"—"n". As shown, planes "m"—"m" and "n"—"n" are not parallel but instead intersect along a line "O"—"O" parallel to the optical axis $OA_{ML}$ of light 11 and located at an established distance "c" below the axis when the light is positioned on camera 15 and the camera aimed at a subject field in the typical manner. At this time, axis "1"—"1" lies horizontal in the manner illustrated in FIG. 2. As also shown in FIG. 2, the parallel optical axes of reflectors 23 are spaced apart the distance "b".

In one embodiment of the invention, dimension "b" was about 2.75 inches, dimension "c" was 1.15 inches, and angle "a" was within the range of about 90 to about 110 degrees. Angle "a" is preferably 100 degrees when light 11 is used to illuminate a rectangular subject field located approximately fifteen feet from light 11. In one example, this field possessed a height of about fifty-eight inches and a width of about seventy-eight inches. As such, the subject field had an aspect ratio of about 3:4 (height:width).

One of the significant features of the invention is the ability to provide the subject field with the aforedefined levels of illumination with a minimal loss of light externally of the field. These levels are deemed sufficient for exposing the film utilized in the described "instant movie" system. Such levels are, of course, also acceptable for the other motion picture camera systems mentioned. To provide this controlled diffusion of light, the reflectors 23 of the invention each include an internal, concave reflecting surface 29 which is generally circular in planes ("p") perpendicular to the reflector's optical axis $OA_L$—$OA_L$. With particularity to FIG. 3, surface 29 is illustrated as being divided into three adjoining diffusing regions 31, 33, and 35 which are oriented about the reflector's optical axis. Each region possesses different controlled diffusing capabilities than the others, with the first region 31 being the most diffuse and region 35 the least diffuse. By controlled diffusion is meant adjusting, e.g. increasing, the angular spread of a bundle of light rays from an element of the reflective surface by a defined amount. This is achieved by maintaining the specularity of the reflecting surface and adjusting local optical power using techniques known in the art.

Figure 3:
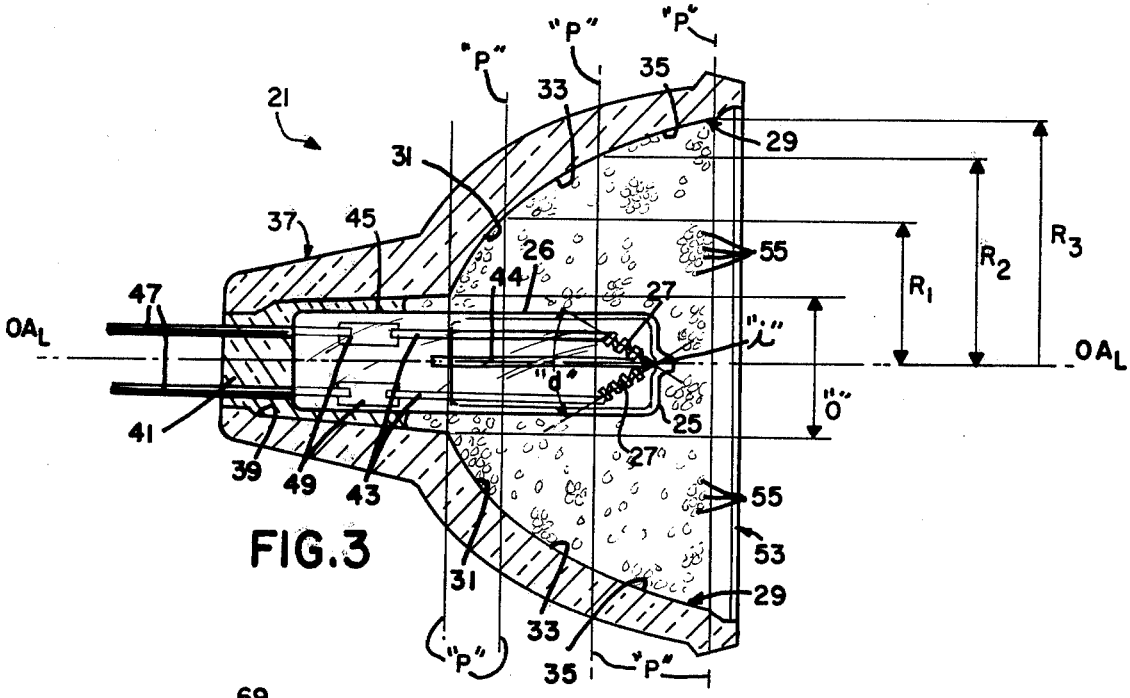
FIG. 3 is a side elevational view, partly in section, of a lamp unit in accordance with a preferred embodiment of the invention.

As further illustrated in FIG. 3, glass reflector 23 also includes a neck portion 37 adjacent the expanded reflective portion which includes surface 29. Portion 37 has an opening 39 therein in which is secured lamp 25 such that the lamp's glass envelope 26 is oriented within the reflective portion and surrounded by regions 31, 33, and 35. Lamp 25 is secured using a suitable insulative adhesive 41, e.g. sauereisen cement. Each lamp includes the aforedescribed glass envelope 26 with the dual tungsten filament structure secured therein. A pair of conductive leads 43 support the outer ends of the structure while a central, non-conductive wire 44 supports the inner ends of the structure at the point of intersection "i". Leads 43 and wire 44 are embedded within press-sealed end 45 of envelope 26. A corresponding pair of conductive pins 47 project from end 45 and neck portion 37, and are electrically joined within press-sealed end 45 to leads 43 via a pair of molybdenum strips 49. In one example of the invention, envelope 26 possessed an overall length of about 1.14 inch, and pins 47 were spaced apart a distance of about 0.20 inch.

As shown in FIG. 1, a common lead 51 connects a single pin 47 from one of the lamps units 21 to a corresponding pin 47 of the other unit. The remaining pins 47 of each unit are electrically joined to a respective one of the terminals 19, which are bent in the manner indicated. The lamps of light 11 are thus connected in series.

With additional regard to FIG. 3, first diffusing region 31 is shown as being positioned nearer optical axis $OA_L$—$OA_L$ than regions 33 and 35 and occupies the radial distance $R_1$ from the optical axis, excluding the annual opening "O" in which is positioned lamp 25. Second diffusing region 33, less diffusing than region 31, is contiguous thereto and occupies an area on surface 29 from the outermost portion of region 31 to the radial distance $R_2$, or in other words, the difference $R_2$–$R_1$ relative to the reflector's optical axis. Simiarly, region 35, less diffusing than region 33, is contiguous thereto and can be represented by the difference $R_3$–$R_2$. In one example of the invention, $R_1$ was 0.375 inch, $R_2$ was 0.600 inch, and $R_3$ was 0.841 inch. Opening "O" had a diameter of 0.500 inch.

Figure 4:
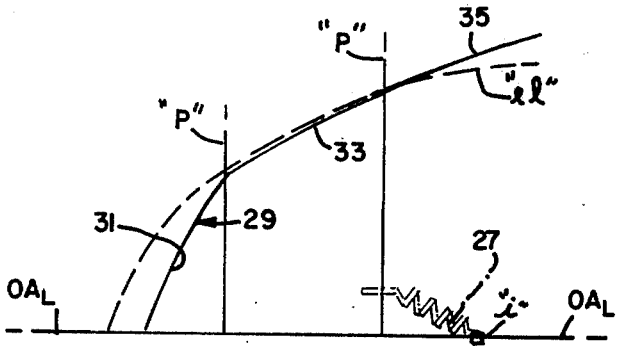
FIG. 4 is a schematic view showing the contour configuration of the reflector of the invention as compared to a typical ellipsoid.

It is preferred that the contours of regions 31, 33 and 35 are different in order to provide the desired, controlled diffusion of light from unit 21. By contour is meant the radial configuration from the reflector's apex to the forward rim portion 53 in planes passing through the optical axis. In one embodiment of the invention, the contour of second region 33 was ellipsoidal. That is, the configuration represented by $R_2$–$R_1$ was a segment of an ellipsoid which, if extended, would constitute an acceptable configuration for many reflectors utilized in the projection lamp art. Such a configuration is represented in FIG. 4, by the dashed line "el". The contour 29 of reflector 23 is shown as a solid line. Region 33 is illustrated as substantially following the ellipsoid's contour. Adjoining regions 31 and 35 have been modified, however. First region 31 has been increased in curvature over that of second region 33, thus narrowing the distance between this surface and the light-emitting filament structure of lamp 25. One of the filaments 27 is shown in phantom in FIG. 4. The third outer region 35 is expanded and flattened, e.g., of a lesser curvature than region 33. The distance between the surface of region 35 and filament 27 is thereby increased over that of a normal ellipsoid if surface 29 were extended along the line "el".

Each diffusing region comprises a plurality of formed specular "peen" elements 55 which may be either of concave or convex configuration within surface 29. In a preferred embodiment, elements 55 were of a partially spherical configuration. In other words, the peening member used to form elements 55 within surface 29 contained a series of extending spherical members which indented surface 29 a pre-established depth when the glass material of reflector 23 was heated and in a softened condition. The peen elements in each of the three diffusing regions are therefore of similar (spherical) configuration. To provide the desired differences in diffusing properties for these regions, however, the radii of curvature of the elements in region 31 were smaller than those in region 33, while those in region 33 were smaller than the radii of curvature of the elements in region 35. In a first example, the elements of region 31 each possessed a radius of curvature of about 0.095 inch. The elements of region 33 each had a radius of curvature of about 0.175 inch while those in region 35 had a radius of curvature of 0.275 inch. In another example, the radius of curvature of each of the elements of region 31 was 0.110 inch, while the elements of regions 33 and 35 possessed radii of curvature of 0.175 and 0.200 inch, respectively. The widths (distance across the widest location) of all of the peen elements formed in accordance with the above schedules were identical, preferably within the range of about 0.030 to 0.050 inch. In yet another example of the invention, the elements possessed the same radii of curvature as defined in the first example above, while the width of each of said elements was within the range of about 0.045 to about 0.065 inch. The elements in all of the above examples were concave. With particular regard to the invention, it is preferred that the radii of curvature of the spherical peen elements of second region 33 be within the range of about 1.50 to about 2.00 times the radii of curvature of the elements of region 31, while the elements of region 35 have a radii of curvature from about 1.75 to about 3.00 times the radii of curvature of the elements in the first region. In the first two examples of the invention as described above, region 31 contained approximately 300 peen elements, region 33 contained 500 elements, and region 35 contained 1,300 elements. In the third example, region 31 contained about 150 elements, region 33 contained 250 elements, and region 35 contained 650 elements. It is to be noted that the controlled diffusion is proportional to the quotient of peen width to peen radius of curvature over a reasonable range. Accordingly, the values defined above may vary in accordance with the stated principle without significantly altering performance.

It is preferred in the present invention to include a dichroic coating on surface 29. Coatings of this type are known in the projection lamp reflector art and are used to reflect the lamp's light in the forward direction while permitting a substantial amount of the heat built up within the reflector to pass therethrough. The result is a cooler operating lamp unit which serves to extend the operating life of the lamp as well as reducing the possibility of injury to the system's user. Understandably, such a coating will not alter the aforedescribed peen shedules.

Figure 5:
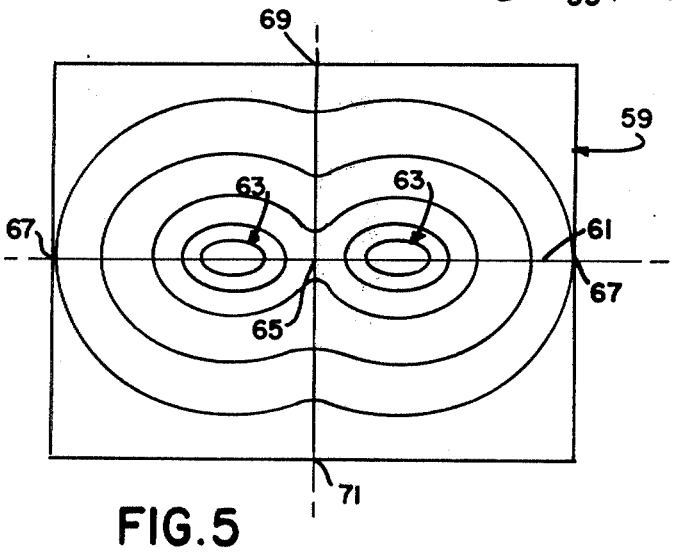
FIG. 5 represents the resulting bimodal intensity pattern on a rectangular subject field from a single lamp unit of the invention in which the unit's planar dual filament is horizontally aligned and the optical axis of the unit's reflector is directed toward the center of the field.
Figure 6:
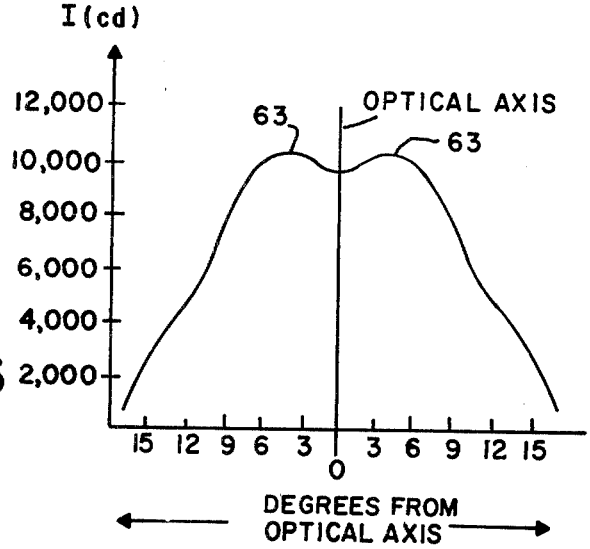
FIG. 6 represents the intensity profile of the subject of FIG. 5 as taken along a horizontal line through the center of the field.

In FIGS. 5 and 6, there is shown the resulting bimodal intensity distribution from one of the lamp units 21 of the invention. The subject field 59 in FIG. 5 is rectangular and of the size and aspect ratio previously described. The intensity profile of FIG. 6 is representative of the intensity readings on field 59 as taken along a horizontal axis 61 through the center of the field. Understandably, lamp unit 21 would be oriented in such a manner that the planar dual filament structure would also be horizontal and would, therefore, lie on a horizontal plane which passes through axis 61. As shown in FIG. 6, the peak intensity of a single unit 21 is approximately 10,200 candelas at the centers of each mode 63, while the intensity at the true center 65 of field 59 is somewhat less, e.g. 9,800 candelas. Center 65 represents the point of intersection between axis 61 and the unit's optical axis $OA_L$—$OA_L$. At the outermost horizontal edges 67 of field 59, as taken along axis 61, the intensity approaches 3,500 candelas as the spread angle of the light beam increases. With field 59 at the established distance of about 15 feet from the lamp unit, the half spread angle from center 65 to one of the outermost edges 67 is approximately 12 degrees. Additionally, the uppermost and lowermost edges 69 and 71 respectively possess intensity values of about 5,000 to 6,000 candelas. The half spread angle at each of these points is about 9 degrees.

Figure 7:
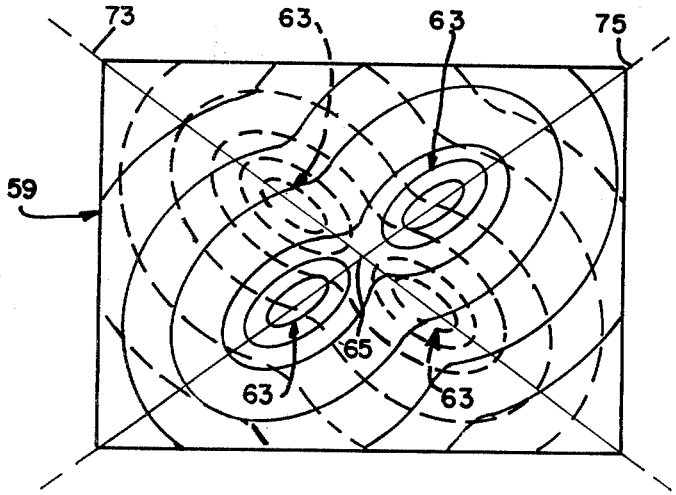
FIG. 7 represents the resulting dual bimodal intensity pattern on a rectangular subject field from the movie light of FIG. 1.

The resulting dual bimodal intensity distribution produced on field 59 by movie light 11 is illustrated in FIG. 7 By rotating the lamp units 21 within light 11 such that the planar dual filament structures are oriented in the predescribed angular relationship, it can be seen that the bimodal intensity distribution from each unit centers on a respective one of the diagonals 73 and 75 of field 59. Diagonals 73 and 75 are illustrated as intersecting at the true center 65 of field 59. In effect, light 11 is able to pump light into the corners of field 59 in order to provide the aforedefined levels of illumination across the field with minimal light losses externally thereof. For example, the intensity produced by one embodiment of light 11 at the center of field 59 was within the range of about 14,000 to about 17,000 candelas while the intensity readings at the corners of the field ranged from about 5,000 to 7,000 candellas. Of added significance, the resulting angularly oriented bimodal intensity contours are each broad enough such that allowance is provided for minor misalignment of lamp units 21 without causing major variations in the corner illumination levels. The above advantages are considered particularly useful because each of the lamp units produce bimodal intensity profiles which have relatively high gradients at the edge of field 59. The end result, therefore, is a maximization of the light level on the subject field. Lamp units and movie lights of the prior art have heretofore been unable to provide these unique capabilities.

Thus, there has been illustrated and described a unique movie light system capable of illuminating a distant subject field with greater levels of uniformity than many known systems. As defined, the system is compact, easy to operate, and inexpensive to replace. It is also readily adaptable to many motion picture cameras, particularly the aforedescribed "instant movie" system. Still further, the defined invention requires no lens or series of lenses to assure the described outputs. This further reduces the cost of the present invention compared to systems of the prior art.

While there have been shown and described what are at present considered the preferred embodiments of the invention, it will be obvious to those skilled in the art that various changes and modifications may be made therein without departing from the scope of the invention as defined by the appended claims. For example, a fuse may be incorporated within the circuitry of the movie light, e.g. across common lead 51, to provide a safety feature. It is also desirable to utilize a plastic, transparent protective member (not shown) in front of each lamp unit. Such a member will, of course, have a minimal attenuating effect on the invention's light output but not to an extent that the operating efficiency of the invention is adversely affected.

What is claimed is:

1. A lamp unit comprising:

a reflector including a concave, internal diffusing surface having first, second, and third individual diffusing regions each located about the optical axis of said reflector, said first region being positioned nearer said optical axis than said second and third regions, said second region being less diffuse than said first region and positioned contiguous thereto, said third region being less diffuse than said second region and positioned contiguous thereto; and an incandescent lamp positioned within said reflector, said lamp including a light-transmitting envelope substantially surrounded by said concave, internal diffusing surface of said reflector and a substantially planar, dual filament structure supported within said envelope, said lamp unit producing a bimodal intensity distribution upon a rectangular subject field located a pre-established distance from said unit.

2. The lamp unit according to claim 1 wherein the contour of said second diffusing region is of ellipsoidal configuration, the contour of said first diffusing region is of non-ellipsoidal configuration having a greater curvature than said second diffusing region, and the contour of said third diffusing region is of non-ellipsoidal configuration having a lesser curvature than said second diffusing region.

3. The lamp unit according to claim 1 wherein each of said diffusing regions comprises a plurality of substantially similar peen elements arranged therein in an established pattern, each of said peen elements of partially spherical configuration.

4. The lamp unit according to claim 3 wherein the radii of curvature of said peen elements of said second region are within the range of about 1.50 to about 2.00 times the radii of curvature of said peen elements of said first region and the radii of curvature of said peen elements of said third region are within the range of about 1.75 to about 3.00 times the radii of curvature of said peen elements of said first region.

5. The lamp unit according to claim 1 wherein said incandescent lamp is a tungsten-halogen lamp.

6. The lamp unit according to claim 5 wherein said dual filament structure comprises a pair of straight, helical coiled members oriented within said envelope at a pre-established angle and electrically connected in a series relationship.

7. The lamp unit according to claim 6 wherein said pre-established angle is within the range of from about 15 to about 100 degrees.

8. The lamp unit according to claim 6 wherein said dual filament structure intersects the optical axis of said reflector at the point of intersection between said helical coiled members.

9. The lamp unit according to claim 1 wherein said lamp unit is a movie light.

10. A high voltage movie light comprising:

a holder adapted for being mounted on a movie camera;

first and second spaced-apart lamp units positioned within said holder, each of said lamp units having a reflector including a concave, internal diffusing surface having first, second, and third individual diffusing regions, each located about the optical axis of said reflector, said first region being positioned nearer said optical axis than said second and third regions, said second region being less diffuse than said first region and positioned contiguous thereto, said third region being less diffuse than said second region and positoned contiguous thereto, and an incandescent lamp positioned within said reflector, said lamp including a light-transmitting envelope substantially surrounded by said concave, internal diffusing surface of said reflector and a substantially planar, dual filament structure supported within said envelope, the plane of said dual filament structure of said first lamp unit intersecting the plane of said dual filament structure of said second lamp unit at a predetermined angle, each of said lamp units producing a bimodal intensity distribution upon a rectangular subject field located in a pre-established distance from said movie light; and means for electrically connecting said first and second lamp units to an external power source.

11. The high voltage movie light according to claim 10 wherein the contour of said second diffusing region of said reflector is of ellipsoidal configuration, the contour of said first diffusing region is of non-ellipsoidal configuration having a greater curvature than said second diffusing region, and the contour of said third diffusing region is of non-ellipsoidal configuration having a lesser curvature than said second diffusing region.

12. The high voltage movie light according to claim 10 wherein each of said diffusing regions comprises a plurality of substantially similar peen elements arranged therein in an established pattern, each of said peen elements of partially spherical configuration.

13. The high voltage movie light according to claim 12 wherein the radii of curvature of said peen elements of said second region are within the range of about 1.50 to about 2.00 times the radii of curvature of said peen elements of said first region and the radii of curvature of said peen elements of said third region are within the range of about 1.75 to about 3.00 times the radii of curvature of said peen elements of said first region.

14. The high voltage movie light according to claim 10 wherein each of said incandescent lamps is a tungsten-halogen lamp and each of said planar dual filament structures comprises a pair of straight, helical coiled members oriented within said envelope at a pre-established angle and electrically connected in a series relationship.

15. The high voltage movie light according to claim 14 wherein said pre-established angle between said straight, helical coiled members is within the range of from about 15 to about 100 degrees.

16. The high voltage movie light according to claim 10 wherein said predetermined angle of intersection between the planes of said dual filament structures is within the range of from about 90 to 110 degrees.

17. The high voltage movie light according to claim 10 wherein said planes of said dual filament structures intersect at a location below the optical axis of said movie light.

18. The high voltage movie light according to claim 10 wherein said electrical connecting means comprises a pair of terminals projecting from said housing and adapted for being electrically joined to said external power source.

19. The high voltage movie light according to claim 10 wherein each of said bimodal intensity distributions is centrally oriented on a respective one of the diagonals of said rectangular subject field.

20. The high voltage movie light according to claim 19 wherein said subject field has an aspect ratio of approximately 3:4.

* * * * *